US011062863B2

(12) United States Patent
Yoshikawa et al.

(10) Patent No.: US 11,062,863 B2
(45) Date of Patent: Jul. 13, 2021

(54) TEMPERATURE SENSITIVE PELLET TYPE THERMAL FUSE

(71) Applicant: SCHOTT Japan Corporation, Koka (JP)

(72) Inventors: Tokihiro Yoshikawa, Koka (JP); Toru Fujita, Koka (JP); Noriyuki Maeda, Koka (JP); Yuichi Nozaki, Koka (JP); Ryota Sekioka, Koka (JP)

(73) Assignee: SCHOTT Japan Corporation, Koka (JP)

( * ) Notice: Subject to any disclaimer, the term of this patent is extended or adjusted under 35 U.S.C. 154(b) by 0 days.

(21) Appl. No.: 16/644,600

(22) PCT Filed: Sep. 13, 2018

(86) PCT No.: PCT/JP2018/033946
§ 371 (c)(1),
(2) Date: Mar. 5, 2020

(87) PCT Pub. No.: WO2019/054437
PCT Pub. Date: Mar. 21, 2019

(65) Prior Publication Data

US 2021/0066008 A1 Mar. 4, 2021

(30) Foreign Application Priority Data

Sep. 14, 2017 (JP) ..... JP2017-176289
Sep. 12, 2018 (JP) ..... JP2018-170136

(51) Int. Cl.
*H01H 37/76* (2006.01)

(52) U.S. Cl.
CPC ..... *H01H 37/761* (2013.01); *H01H 37/764* (2013.01); *H01H 2037/762* (2013.01); *H01H 2037/768* (2013.01); *H01H 2037/769* (2013.01)

(58) Field of Classification Search
CPC .. H01H 37/761; H01H 37/764; H01H 37/765; H01H 37/767; H01H 2037/762; H01H 2037/768; H01H 2037/769
See application file for complete search history.

(56) References Cited

U.S. PATENT DOCUMENTS 4,246,561 A * 1/1981 McVey ..... H01H 37/765 337/407
4,401,965 A * 8/1983 Backlund ..... H01H 37/765 337/407

(Continued)

FOREIGN PATENT DOCUMENTS

JP 01-154422 A 6/1989
JP 2006-269380 A 10/2006

(Continued)

OTHER PUBLICATIONS

PCT Examiner Yukari Nakamura, PCT International Preliminary Report on Patentability including English Translation of PCT Written Opinion of the International Searching Authority for International Application PCT/JP2018/033946, dated Mar. 17, 2020, 11 pages, International Bureau of WIPO, Geneva, Switzerland.

(Continued)

*Primary Examiner* — Jacob R Crum
(74) *Attorney, Agent, or Firm* — W. F. Fasse

(57) ABSTRACT

The temperature sensitive pellet type thermal fuse includes a cylindrical case which has a first end and a second end, a temperature sensitive pellet, an insulating tube, a first lead which is inserted into the insulating tube and has an inner end serving as a contact portion, a movable contact which is electrically connected to the cylindrical case, a weak compression spring, a strong compression spring, and a second lead which is disposed on the second end of the cylindrical case. The movable contact includes a projecting contact portion which is provided at a central part of the movable (Continued)

contact, and the projecting contact portion and the contact portion of the first lead are in contact with each other inside the insulating tube.

13 Claims, 6 Drawing Sheets

(56) References Cited

U.S. PATENT DOCUMENTS

| | | | | |
|---|---|---|---|---|
| 4,411,061 | A * | 10/1983 | Clapper | H01H 37/765 29/460 |
| 4,630,023 | A * | 12/1986 | Gawron | H01H 37/765 337/401 |
| 4,825,187 | A | 4/1989 | Cenky | |
| 2010/0219929 | A1* | 9/2010 | Lee | H01H 37/765 337/182 |
| 2014/0253281 | A1* | 9/2014 | Suzaki | H01H 37/32 337/416 |
| 2015/0015360 | A1 | 1/2015 | Matsuo et al. | |
| 2016/0042905 | A1* | 2/2016 | Xu | H01H 85/36 337/148 |
| 2017/0345602 | A1* | 11/2017 | Yoon | H01H 85/06 |
| 2017/0345603 | A1* | 11/2017 | Yoon | H01H 85/10 |
| 2018/0266725 | A1* | 9/2018 | Reichl | F24H 9/2071 |

FOREIGN PATENT DOCUMENTS

| | | | |
|---|---|---|---|
| JP | 3161636 | U | 7/2010 |
| JP | 2011-210611 | A | 10/2011 |
| JP | 2012-248490 | A | 12/2012 |
| JP | 2013-196984 | A | 9/2013 |
| JP | 2014-099249 | A | 5/2014 |

OTHER PUBLICATIONS

English translation of PCT International Search Report of the International Searching Authority for International Application PCT/JP2018/033946, dated Dec. 18, 2018, 2 pages, Japanese Patent Office, Tokyo, Japan.

* cited by examiner

TEMPERATURE SENSITIVE PELLET TYPE THERMAL FUSE

TECHNICAL FIELD

The present disclosure relates to a temperature sensitive pellet type thermal fuse configured to break an electric circuit when an overheat of an electric device is detected.

BACKGROUND ART

Thermal fuses are used in home appliances, industrial electrical devices and industrial electronic devices as a protective component that senses the temperature of a device and quickly breaks an electric circuit when the device is abnormally overheated. The thermal fuses are installed in products such as home appliances, portable devices, communication devices, office equipments, in-vehicle devices, AC adapters, chargers, motors, and batteries, for example.

There are various types of thermal fuses, and such a thermal fuse generally has a rated current of approximately 0.5 A to approximately 15 A. A temperature sensitive pellet type thermal fuse is suitably used as a thermal fuse with a high rated current of 6 A or more.

A typical example of such temperature sensitive pellet type thermal fuse is disclosed in PTL 1 or PTL 2. The temperature sensitive pellet type thermal fuse includes a hollow cylindrical metal case, a first lead and a second lead which are disposed at both ends of the metal case, respectively, a temperature sensitive pellet arranged in contact with the second lead, and a movable contact which is in contact with the first lead via the temperature sensitive pellet and biased in the separation direction.

When the temperature of an electric device installed with the temperature sensitive pellet type thermal fuse reaches a predetermined temperature or more, the temperature sensitive pellet melts or softens. As a result, the movable contact is separated from the first lead by the biasing force, and thereby the circuit is broken.

Such temperature sensitive pellet type thermal fuse is installed at a position where it is desired to detect an abnormal temperature rise of the electric device. The temperature sensitive pellet type thermal fuse is connected in series to the electric device, and the electric device is supplied with power or distributes power through the intermediary of the temperature sensitive pellet type thermal fuse.

The temperature sensitive pellet is solid at normal temperature. At normal temperature, the movable contact is pressed by the biasing force into contact with an end of the first lead inside the metal case. Therefore, the first lead, the metal case, the movable contact, and the second lead are maintained in the conductive state.

When the temperature of the position where temperature sensitive pellet type thermal fuse is installed rises to the operating temperature of the temperature sensitive pellet type thermal fuse due to abnormal flow of current such as a short circuit of the electric device, the temperature sensitive pellet will melt, and thus, the biasing force that biases the movable contact against the end of the first lead decreases. Therefore, the movable contact is separated from the first lead, and a non-conductive state is established between the first lead and the second lead. As a result, the supply of power to the electric device or the distribution of power by the electric device is stopped so as to prevent the temperature of the electric device from further rising, which makes it possible to prevent electric device from getting overheated or prevent an accident such as fire from occurring due to the overheating.

CITATION LIST

Patent Literature

PTL 1: Japanese Patent Laying-Open No. 01-154422
PTL 2: Utility Model Registration No. 3161636

SUMMARY OF INVENTION

Technical Problem

The temperature sensitive pellet type thermal fuse is a non-return type protective element, it is necessary to more completely and reliably ensure the interruption of power supply by preventing the electrical conduction from being re-established after operation. Therefore, it is desirable that the withstand voltage and the insulation resistance between the first lead and the second lead be as high as possible after the operation of the temperature sensitive pellet type thermal fuse.

A conventional temperature sensitive pellet type thermal fuse 200 illustrated in FIGS. 6 and 7 is configured to increase the creeping distance or spatial distance without greatly changing the outer diameter as compared with an existing product so as to suppress the occurrence of a short circuit which is caused by an arc discharge during or after the operation.

An object of the present disclosure is to provide a temperature sensitive pellet type thermal fuse capable of more reliably interrupting power supply after operation.

Solution to Problem

A temperature sensitive pellet type thermal fuse according to the present disclosure includes a cylindrical case which is electrically conductive and has a first end and a second end, a temperature sensitive pellet which is disposed inside the cylindrical case and configured to melt at a specific temperature, an insulating tube which is disposed on the side of the first end inside the cylindrical case, a first lead which is inserted into the insulating tube and has an inner end serving as a contact portion, a movable contact which is disposed inside the cylindrical case and is electrically connected to the cylindrical case, a weak compression spring which is configured to bias the insulating tube and the movable contact, a strong compression spring which is configured to bias the temperature sensitive pellet and the movable contact, and a second lead which is disposed on the second end of the cylindrical case. The movable contact includes a projecting contact portion which is provided at a central part of the movable contact, and the projecting contact portion and the contact portion of the first lead are in contact with each other inside the insulating tube.

In the temperature sensitive pellet type thermal fuse, the projecting contact portion of the movable contact may be formed by embossing.

In the temperature sensitive pellet type thermal fuse, the projecting contact portion of the movable contact may have a thickness larger than that of the other portions of the movable contact.

In the temperature sensitive pellet type thermal fuse, the movable contact may include a movable contact main body and a contact member which is fixed to the movable contact main body and constitutes the projecting contact portion.

In the temperature sensitive pellet type thermal fuse, the contact member may be inserted through the movable contact main body so as to be fixed.

The temperature sensitive pellet type thermal fuse may further include a metal plate arranged in contact with the movable contact, and the contact member may be inserted through the movable contact and the metal plate.

In the temperature sensitive pellet type thermal fuse, a part of the projecting contact portion in contact with the contact portion of the first lead may be made of a contact material.

In the temperature sensitive pellet type thermal fuse, a part of the contact member in contact with the contact portion of the first lead may be made of a contact material, and a part of the contact member in contact with the movable contact main body may be made of a material different from the contact material.

In the temperature sensitive pellet type thermal fuse, the contact material may be silver or silver alloy containing at least one element selected from the group consisting of nickel, copper, tin and indium.

In the temperature sensitive pellet type thermal fuse, the contact material may be an oxide alloy containing an oxide of at least one element selected from the group consisting of silver, nickel, copper, tin and indium.

In the temperature sensitive pellet type thermal fuse, the contact material may be copper or copper alloy.

In the temperature sensitive pellet type thermal fuse, a surface of the projecting contact portion may be coated with a silver layer.

In the temperature sensitive pellet type thermal fuse, the contact member may be made of AgNi, and the movable contact main body may be made of AgCuO or Ag-plated copper alloy.

Advantageous Effects of Invention

According to the temperature sensitive pellet type thermal fuse of the present disclosure, the movable contact is provided with a projecting contact portion, and the projecting contact portion and the contact portion of the first lead are brought into contact with each other inside the insulating tube, which makes it possible to shield metal components arranged outside the insulating tube from an arc discharge that is generated when the projecting contact portion of the movable contact and the contact portion of the first lead are separated apart. As a result, it is possible to prevent, for example, components arranged around the contact portion from being welded together by the arc discharge that is generated inside the cylindrical case so as to avoid insulation deterioration or insulation breakdown after operation.

DESCRIPTION OF EMBODIMENTS

Figure 1:
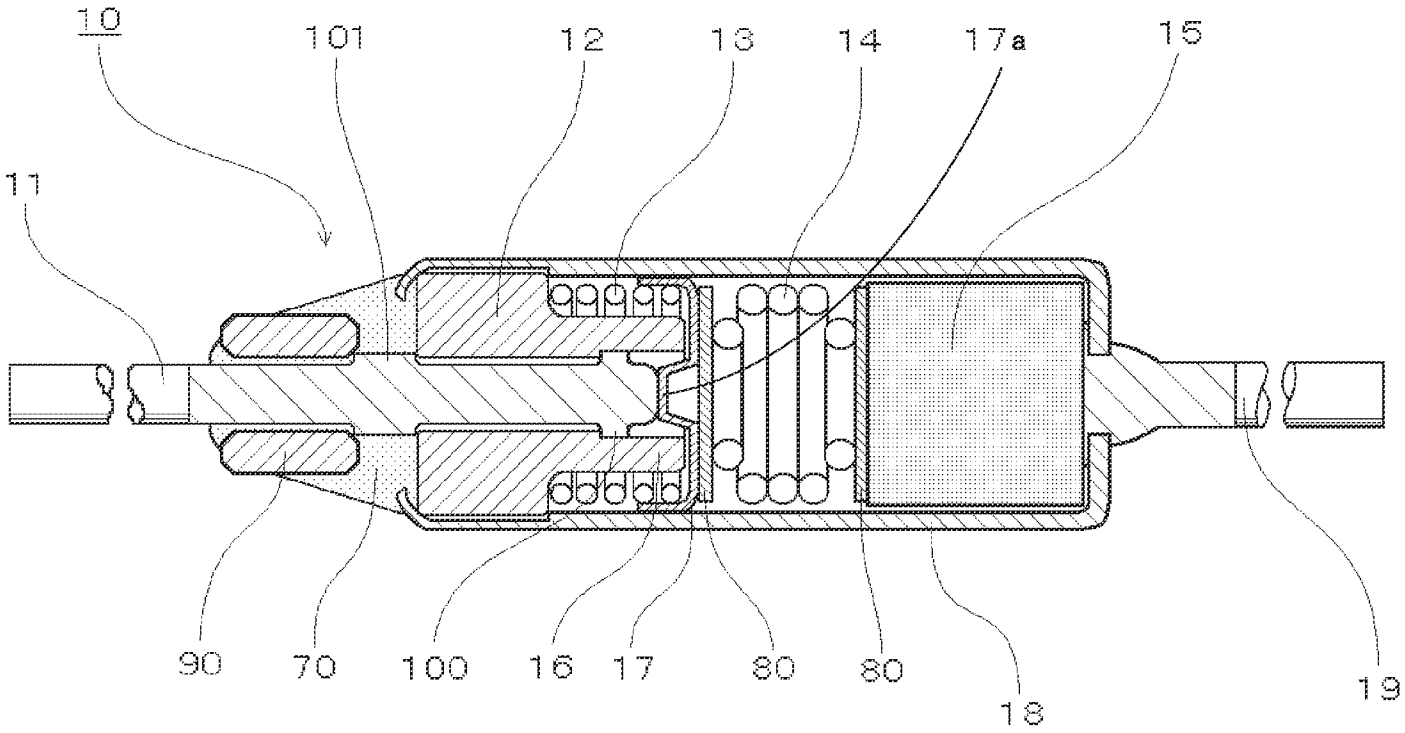
FIG. 1 is a cross-sectional view illustrating a temperature sensitive pellet type thermal fuse 10 according to an embodiment.

A temperature sensitive pellet type thermal fuse according to the present embodiment includes a cylindrical case which is electrically conductive and has a first end and a second end, a temperature sensitive pellet which is disposed inside the cylindrical case and configured to melt at a specific temperature, an insulating tube which is disposed on the side of the first end inside the cylindrical case, a first lead which is inserted into the insulating tube and has an inner end serving as a contact portion, a movable contact which is disposed inside the cylindrical case and is electrically connected to the cylindrical case, a weak compression spring which is configured to bias the insulating tube and the movable contact, a strong compression spring which is configured to bias the temperature sensitive pellet and the movable contact, and a second lead which is disposed on the second end of the cylindrical case. The movable contact includes a projecting contact portion which is provided at a central part of the movable contact. The projecting contact portion and the contact portion of the first lead are in contact with each other inside the insulating tube. The cylindrical case is preferably excellent in electrical conductivity and thermal conductivity.

The temperature sensitive pellet type thermal fuse may be further provided with two metal plates to sandwich the strong compression spring. In one preferable arrangement, the projecting contact portion may be formed into the shape of a cylinder or a frustum (truncated cone). The projecting contact portion may be formed into a thick portion, in other words, a part which has a larger thickness than the other portion. The thick portion may be made of a contact material.

In another preferable configuration, the projecting contact portion may be formed in a central part of the movable contact by embossing or the like. In this case, the surface opposite to the projecting contact portion is concave.

An inner end of the first lead constitutes a fixed contact portion and is disposed inside the insulating tube. The projecting contact portion of the movable contact comes into contact with the fixed contact portion at the inner end of the first lead to form a contact. Thus, the contact surface between the fixed contact portion and the movable contact is located deeply inside the insulating tube.

When the movable contact is separated from the fixed contact portion during the power supply, the contact surface where an arc is generated is housed inside the insulating tube. Thereby, the components constituting a movable mechanism of the thermal fuse, for example, the springs and the cylindrical case can be effectively shielded from the arc.

In another embodiment, the movable contact is composed of a movable contact main body and a contact member fixed to the movable contact main body. The movable contact main body is provided with a through hole. The contact member is inserted through the through hole and both ends of the inserted contact member are caulked, so that the contact member is fixed to the movable contact main body. The projecting contact portion is in contact with the contact portion of the first lead in a detachable manner. Thus, the temperature sensitive pellet type thermal fuse may house the contact surface between the projecting contact portion and the contact portion of the first lead inside the peripheral wall of the insulating tube and shield it from the surroundings.

The temperature sensitive pellet type thermal fuse may be further provided with two metal plates made of copper or stainless steel to sandwich the strong compression spring. Only a part of the projecting contact portion which is brought into contact with the contact portion of the first lead may be made of the contact material, or alternatively, the entire part of the projecting contact portion may be made of the contact material.

For example, a part (the shielding side) which is brought into contact with the contact portion of the first lead may be made of a contact material such as silver or silver alloy containing at least one element selected from the group consisting of nickel, copper, tin and indium. Alternatively, the contact material may be an oxide alloy containing an oxide of at least one element selected from the group consisting of silver, nickel, copper, tin and indium.

When the projecting contact portion is constituted by a contact member fixed to the movable contact main body, a part (the movable side) which is brought into contact with the movable contact main body may be made of copper or copper alloy. More preferably, the surface of the portion may be coated with a silver layer.

In yet another embodiment, the movable contact main body and the metal plate are each provided with a through hole. The contact member is inserted through the through holes of the movable contact and the metal plate, and both ends of the inserted contact member are welded, brazed or caulked so as to fix the movable contact main body and the metal plate together, so that the projecting contact portion is provided. The projecting contact portion and the contact portion of the first lead are in contact with each other in a detachable manner. Thus, the temperature sensitive pellet type thermal fuse is provided in which the contact surface between the projecting contact portion and the contact portion of the first lead is housed inside the peripheral wall of the insulating tube, which shields the contact surface from the surroundings.

Only a part of the contact member which is brought into contact with the contact portion of the first lead may be made of the contact material, or alternatively, the entire part of the contact member may be made of the contact material. The projecting contact portion may be made of any material as long as at least a part (the shielding side) which is brought into contact with the contact portion of the first lead is made of a material suitable for an electrical contact.

Although the contact member is not particularly limited, preferably, it may be made of silver or silver alloy containing at least one element selected from the group consisting of nickel, copper, tin and indium. Alternatively, the contact member may be made of an oxide alloy containing an oxide of at least one element selected from the group consisting of silver, nickel, copper, tin and indium. The portion (the movable side) in contact with the movable contact main body of the contact member is made of copper or copper alloy. The contact member may be further coated with a silver layer on its surface.

Each embodiment of the present invention will be described in more details with reference to the drawings.

As illustrated in FIG. 1, a temperature sensitive pellet type thermal fuse 10 according to a first embodiment has a cylindrical case 18 made of silver-plated copper alloy. A second lead 19 made of silver-plated copper is fixed to one end of the cylindrical case 18 by caulking.

Inside the cylindrical case 18, a temperature sensitive pellet 15, two metal plates 80, a strong compression spring 14, a movable contact 17, an insulating tube 12, an inner end of a first lead 11, and a weak compression spring 13 are disposed.

The temperature sensitive pellet 15 is configured to melt at a specific temperature (operating temperature). The strong compression spring 14 is sandwiched between two metal plates 80 and configured to press the temperature sensitive pellet 15. The movable contact 17 is in contact with one of the metal plates 80 and in sliding contact with the inner wall of the cylindrical case 18. The movable contact 17 is made of silver alloy. The insulating tube 12 is disposed at the side of the cylindrical case 18 where an opening is provided. The insulating tube 12 is made of ceramics.

The first lead 11 is inserted through a central part of the insulating tube 12. The first lead 11 is made of silver-plated copper, and an inner end thereof constitutes the contact portion 100. The insulating tube 12 and the first lead 11 are provided so as to fill the opening provided at the end of the cylindrical case 18.

The weak compression spring 13 is interposed between the insulating tube 12 and the movable contact 17. The opening of the cylindrical case 18 is hermetically sealed by a sealing material 70 made of epoxy resin that also surrounds an annular shoulder 101 of the first lead 11. A porcelain tube 90 is provided at an edge portion of the sealing material 70.

The movable contact 17 has a projecting contact portion 17*a* provided at a central part by embossing. The movable contact 17 has a cavity on the opposite side of the projecting contact portion. The projecting contact portion 17*a* and the contact portion 100 of the first lead 11 are in contact with each other. The contact surface between the movable contact 17 and the contact portion 100 of the first lead 11 is surrounded by the peripheral wall 16 of the insulating tube 12 and shielded from the surroundings. The projecting contact portion 17*a* and the first lead 11 are in contact with each other inside the insulating tube 12.

Figure 2:
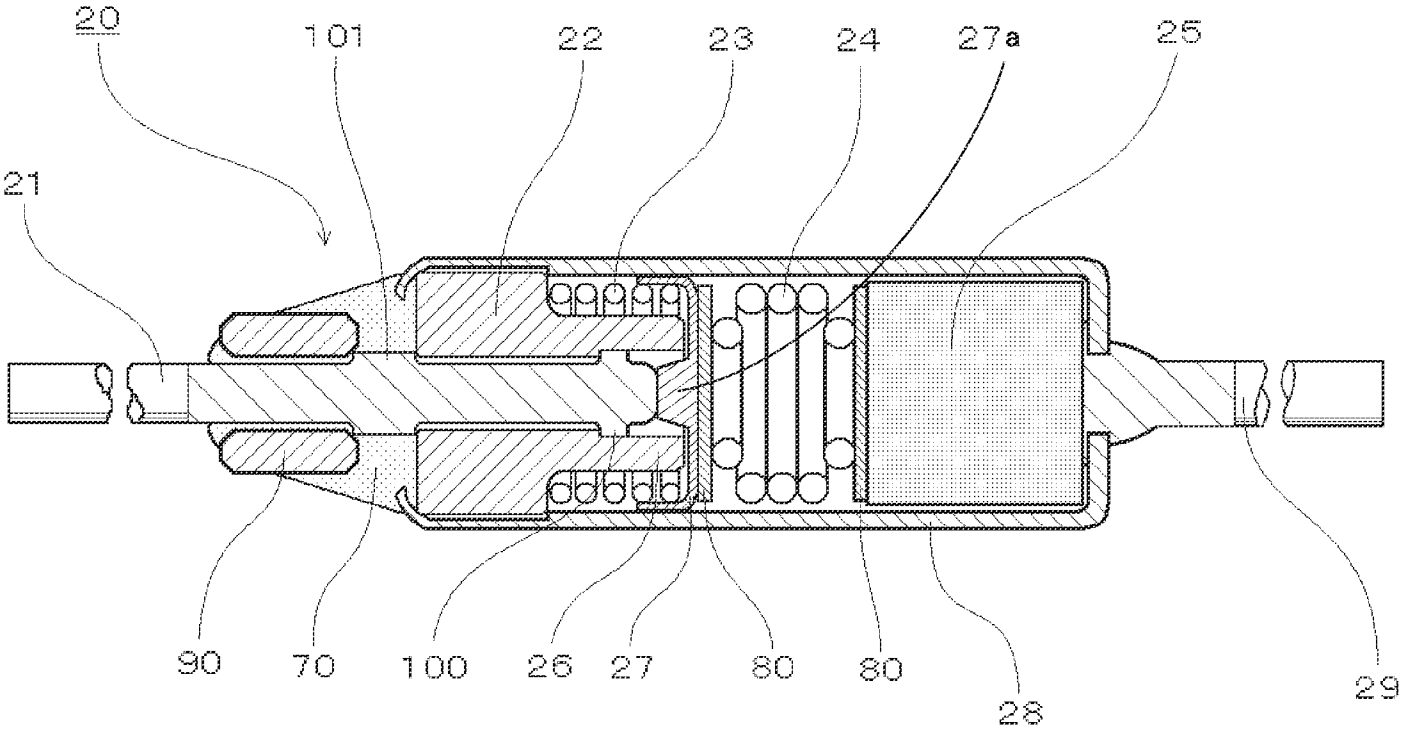
FIG. 2 is a cross-sectional view illustrating a temperature sensitive pellet type thermal fuse 20 according to an embodiment.

As illustrated in FIG. 2, a temperature sensitive pellet type thermal fuse 20 according to a second embodiment has a cylindrical case 28 made of silver-plated copper alloy. A second lead 29 made of silver-plated copper is fixed to one end of the cylindrical case 28 by caulking.

Inside the cylindrical case 28, a temperature sensitive pellet 25, two metal plates 80, a strong compression spring 24, a movable contact 27, an insulating tube 22, an inner end of a first lead 21, and a weak compression spring 23 are disposed.

The temperature sensitive pellet 25 is configured to melt at a specific temperature. The strong compression spring 24 is sandwiched between two metal plates 80 and configured to press the temperature sensitive pellet 25. The movable contact 27 is in contact with one of the metal plates 80 and in sliding contact with the inner wall of the cylindrical case 28. The movable contact 27 is made of silver alloy. The insulating tube 22 is disposed at the side of the cylindrical case 28 where an opening is provided. The insulating tube 22 is made of ceramics.

The first lead 21 is inserted through the central part of the insulating tube 22. The first lead 21 is made of silver-plated copper, and an inner end thereof constitutes the contact portion. The weak compression spring 23 is interposed between the insulating tube 22 and the movable contact 27.

The opening of the cylindrical case 28 is hermetically sealed by a sealing material 70 made of epoxy resin. A porcelain tube 90 is provided at an edge portion of the sealing material 70.

The movable contact 27 has a projecting contact portion 27*a* which is formed by a thick portion in the shape of a truncated cone in the central part. The projecting contact portion 27*a* and the contact portion of the first lead 21 are in contact with each other. The contact surface between the movable contact 27 and the contact portion of the first lead 21 is surrounded by the peripheral wall 26 of the insulating tube 22 and shielded from the surroundings. The projecting contact portion 27*a* and the first lead 21 are in contact with each other inside the insulating tube.

The projecting contact portion may be formed by fixing a separate contact member to the movable contact main body. For example, the projecting contact portion may be formed by bonding or adhering a conductive material different from the material of the movable contact main body on one surface of the movable contact main body via a joining means such as resistance welding, soldering or a conductive adhesive.

The projecting contact portion may be formed by fixing a contact member in the shape of a cylinder or frustum to a plate-shaped movable contact. As an example, the projecting contact portion 37*a* formed by the contact member in FIG. 3 may be made of AgNi, and the movable contact main body which is the plate portion of the movable contact 37 may be made of AgCuO or Ag-plated copper alloy.

As long as the movable contact 37 does not hinder the electrical conduction, the movable contact main body and the contact member may be formed of different members or made of different materials. In the movable contact 17 as illustrated in FIG. 1, the projecting contact portion 17*a* may be made of a separate member or a different material from the movable contact main body.

Figure 3:
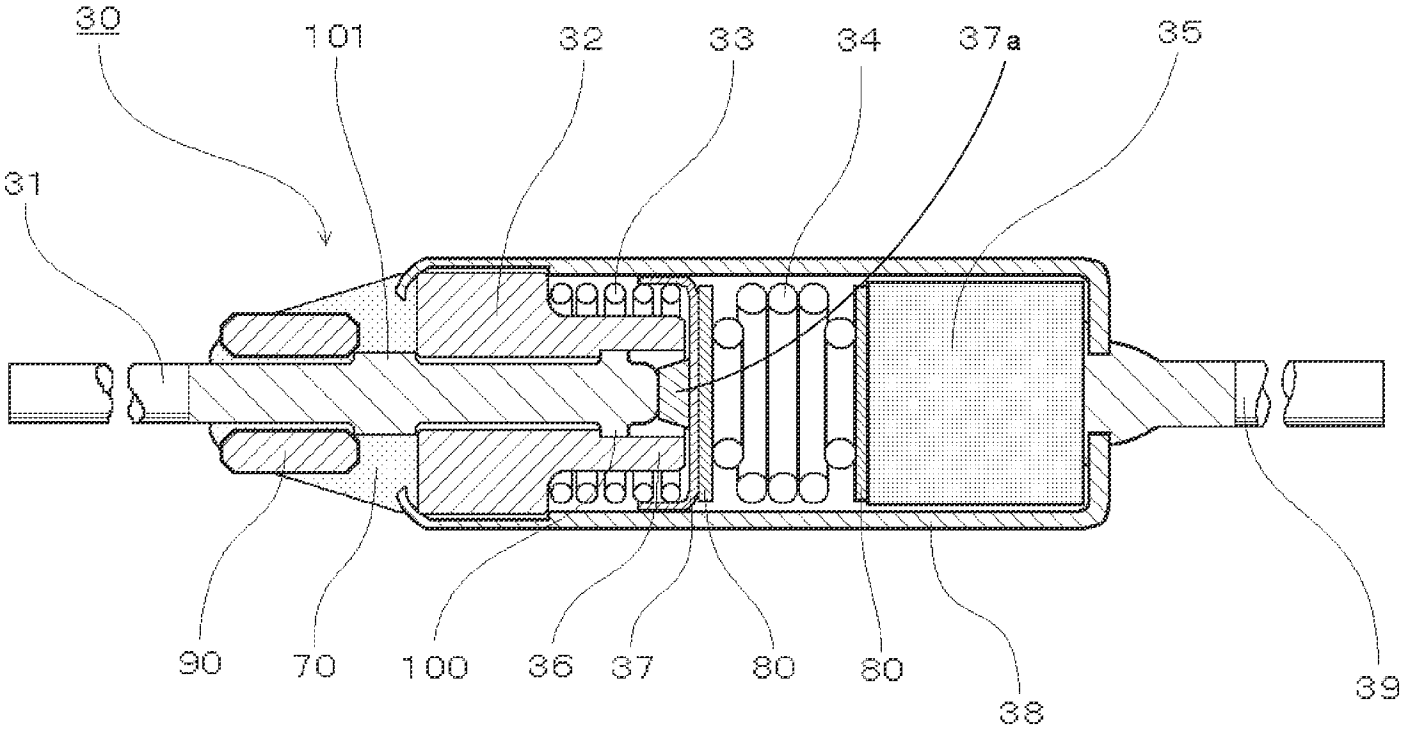
FIG. 3 is a cross-sectional view illustrating a temperature sensitive pellet type thermal fuse 30 according to an embodiment.

The temperature sensitive pellet type thermal fuse 20 according to the second embodiment may be modified as in a third embodiment illustrated in FIG. 3. A temperature sensitive pellet type thermal fuse 30 of the embodiment illustrated in FIG. 3 has a cylindrical case 38 made of silver-plated copper alloy. A second lead 39 made of silver-plated copper is fixed to one end of the cylindrical case 38 by caulking.

Inside the cylindrical case 38, temperature sensitive pellet 35, two metal plates 80, a strong compression spring 34, a movable contact 37, an insulating tube 32, an inner end of a first lead 31, and a weak compression spring 33 are disposed.

The temperature sensitive pellet 35 is configured to melt at a specific temperature. The strong compression spring 34 is sandwiched between two metal plates 80 and configured to press the temperature sensitive pellet 35. The movable contact 37 is in contact with one of the metal plates 80 and in sliding contact with the inner wall of the cylindrical case 38. The movable contact 37 is made of silver alloy. The insulating tube 32 is disposed at the side of the cylindrical case 38 where an opening is provided. The insulating tube 32 is made of ceramics.

The first lead 31 is inserted through the central part of the insulating tube 32. The first lead 31 is made of silver-plated copper. The weak compression spring 33 is interposed between the insulating tube 32 and the movable contact 37.

The opening of the cylindrical case 38 is hermetically sealed by a sealing material 70 made of epoxy resin. A porcelain tube 90 is provided at an edge portion of the sealing material 70.

The movable contact 37 has a projecting contact portion 37*a* which is formed by joining a contact member made of silver alloy tip member in the shape of a truncated cone to a central part of the movable contact main body (the plate portion of the movable contact 37). The projecting contact portion 37*a* and the contact portion of the first lead 31 are in contact with each other. The contact surface between the movable contact 37 and the contact portion of the first lead 31 is surrounded by the peripheral wall 36 of the insulating tube 32 and shielded from the surroundings. The projecting contact portion 37*a* and the first lead 31 are in contact with each other inside the insulating tube 32.

Figure 4:
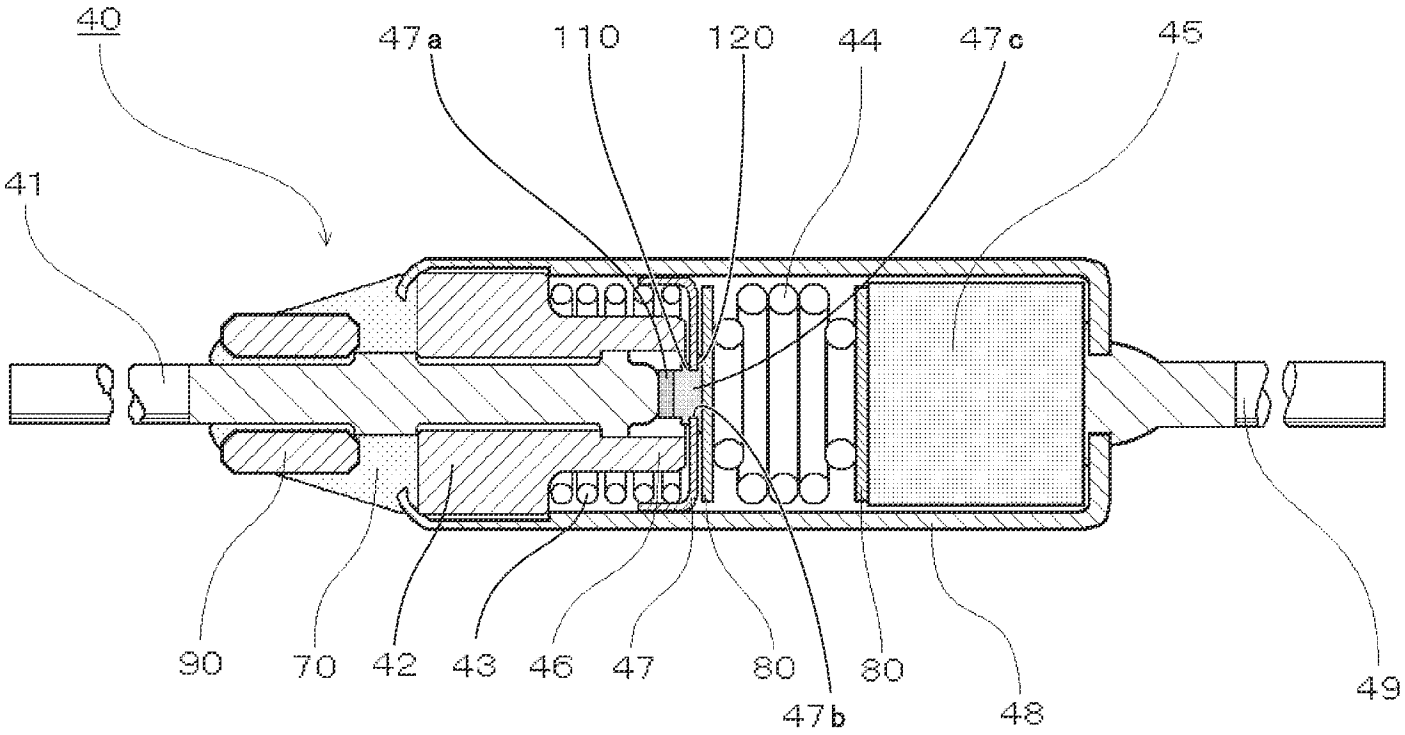
FIG. 4 is a cross-sectional view illustrating a temperature sensitive pellet type thermal fuse 40 according to an embodiment.

As illustrated in FIG. 4, a temperature sensitive pellet type thermal fuse 40 according to a fourth embodiment has a cylindrical case 48 made of silver-plated copper alloy. A second lead 49 made of silver-plated copper is fixed to one end of the cylindrical case 48 by caulking. Inside the cylindrical case 48, a temperature sensitive pellet 45, two metal plates 80, a strong compression spring 44, a movable contact 47, an insulating tube 42, a first lead 41, and a weak compression spring 43 are disposed.

The temperature sensitive pellet 45 is configured to melt at a specific temperature. Two metal plates 80 are made of stainless steel. The strong compression spring 44 is sandwiched between two metal plates 80 and configured to press the temperature sensitive pellet 45. The movable contact 47 is in contact with one of the metal plates 80 and in sliding contact with the inner wall of the cylindrical case 48. The movable contact 47 is made of silver alloy.

The insulating tube 42 is disposed at the side of the cylindrical case 48 where an opening is provided. The insulating tube 42 is made of ceramics. The first lead 41 is inserted through the central part of the insulating tube 42. The first lead 41 is made of silver-plated copper, and an inner end thereof constitutes the contact portion. The weak compression spring 43 is interposed between the insulating tube 42 and the movable contact 47.

The opening of the cylindrical case 48 is hermetically sealed by a sealing material 70 made of epoxy resin. A porcelain tube 90 is provided at an edge portion of the sealing material 70.

The movable contact 47 is provided with a through hole 47*b* in the central part, and a contact member 47*c* is inserted through the through hole 47*b*. The contact member 47*c* is fixed to the movable contact main body by caulking both ends of the inserted contact member 47*c*. The contact member 47*c* constitutes a projecting contact portion 47*a*.

The projecting contact portion 47*a* and the contact portion of the first lead 41 are in contact with each other. The contact surface between the movable contact 47 and the contact portion of the first lead 41 is surrounded by the peripheral wall 46 of the insulating tube 42 and shielded from the surroundings. The metal plate 80 may be made of copper. Only a part (the shielding side) of the projecting contact portion 47*a* which is in contact with the contact portion of the first lead 41 may be made of the contact material, or alternatively, the entire part of the projecting contact portion 47*a* may be made of the contact material.

Figure 5:
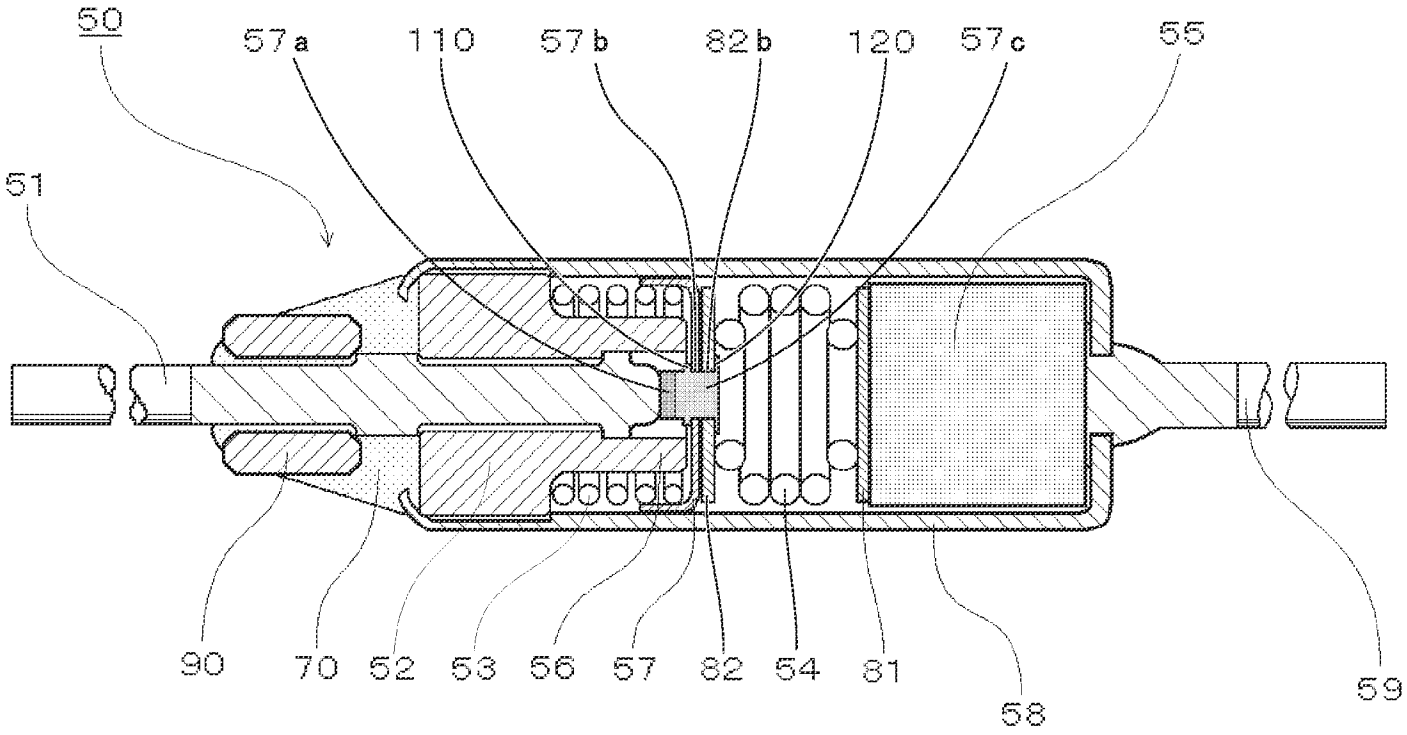
FIG. 5 is a cross-sectional view illustrating a temperature sensitive pellet type thermal fuse 50 according to an embodiment.
Figure 6:
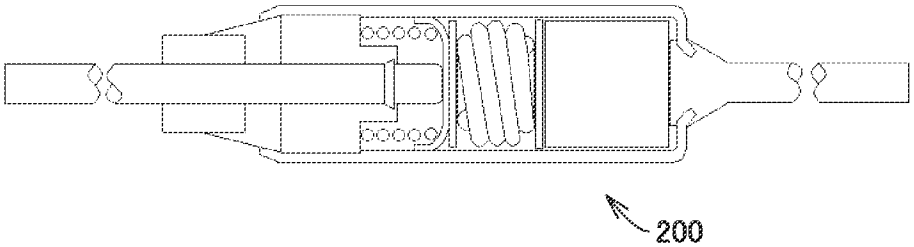
FIG.6 PRIOR ART
FIG. 6 is a cross-sectional view illustrating a conventional temperature sensitive pellet type thermal fuse.
Figure 7:
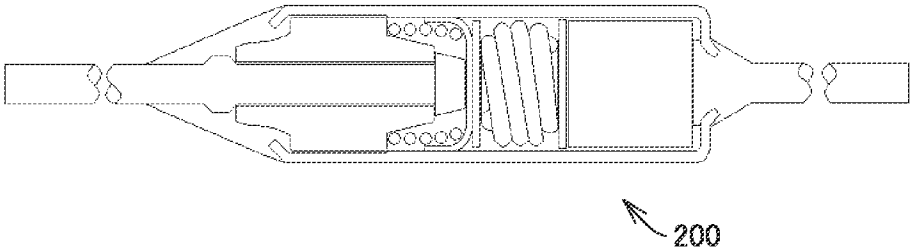
FIG.7 PRIOR ART
FIG. 7 is a cross-sectional view illustrating a conventional temperature sensitive pellet type thermal fuse.

As illustrated in FIG. 5, a temperature sensitive pellet type thermal fuse 50 according to a fifth embodiment has a cylindrical case 58 made of silver-plated copper alloy. A second lead 59 made of silver-plated copper is fixed to one end of the cylindrical case 58 by caulking.

Inside the cylindrical case 58, a temperature sensitive pellet 55, a first metal plate 81, a second metal plate 82, a strong compression spring 54, a movable contact 57, an insulating tube 52, an inner end of a first lead 51, and a weak compression spring 53 are disposed.

The temperature sensitive pellet 55 is configured to melt at a specific temperature. The first metal plate 81 and the second metal plate 82 are made of stainless steel. The strong compression spring 54 is sandwiched between the first metal plate 81 and the second metal plate 82 and configured to press the temperature sensitive pellet 55. The movable contact 57 is in contact with the second metal plate 82 and in sliding contact with the inner wall of the cylindrical case 58. The movable contact 57 is made of silver alloy.

The insulating tube 52 is disposed at the side of the cylindrical case 58 where an opening is provided. The insulating tube 52 is made of ceramics. The first lead 51 is inserted through the central part of the insulating tube 52, and an inner end thereof constitutes the contact portion. The first lead 51 is made of silver-plated copper, and an inner end thereof serves as the contact portion. The weak compression spring 53 is interposed between the insulating tube 52 and the movable contact 57.

The opening of the cylindrical case 58 is hermetically sealed by a sealing material 70 made of epoxy resin. A porcelain tube 90 is provided at an edge portion of the sealing material 70.

The movable contact 57 is provided with a through hole 57*b* in the central part, and the second metal plate 82 is provided with a through hole 82*b* in the central part. A contact member 57*c* is inserted through the through hole 57*b* of the movable contact 57 and the through hole 82*b* of the second metal plate 82, and both ends of the inserted contact member are caulked so as to fix the movable contact 57 and the second metal plate 82. The contact member 57*c* constitutes a projecting contact portion 57*a*.

The projecting contact portion 57*a* and the contact portion of the first lead 51 are in contact with each other. The contact surface between the movable contact 57 and the contact portion of the first lead 51 is surrounded by the peripheral wall 56 of the insulating tube 52 and shielded from the surroundings. Only a part of the projecting contact portion 57*a* which is in contact with the contact portion of the first lead 51 may be made of the contact material, or alternatively, the entire part of the projecting contact portion 57*a* may be made of the contact material.

In the projecting contact portion 47*a* according to the fourth embodiment and the projecting contact portion 57*a* according to the fifth embodiment, when only a part (the shielding side) in contact with the contact portion of the first lead is made of the contact material, the contact material may be silver or silver alloy containing at least one element selected from the group consisting of nickel, copper, tin and indium. Alternatively, the contact material may be an oxide alloy containing an oxide of at least one element selected from the group consisting of silver, nickel, copper, tin and indium. A part (the movable side) in contact with the movable contact main body of the contact member 47*c* or 57*c* may be made of copper or copper alloy, and more preferably, the surface of the portion may be coated with a silver layer. In this case, the shielding side and the movable side of the contact member is made of different materials.

One end of the contact member 47*c* or 57*c* may function as a rivet. The contact member 47*c* or 57*c* is provided with a flange 110 in the middle. The flange 110 functions as a stopper for the movable contact main body and the second metal plate 82. A tip of the contact member 47*c* or 57*c* beyond the flange 110 is formed into a cylindrical shape, for example. After the tip is inserted through the through hole 47*b* or 57*b* of the movable contact main body and the through hole 82*b* of the second metal plate 82, the cylindrical tip is deformed to form a caulking member 120. Thus, the contact member 47*c* or 57*c* is fixed to the movable contact main body and the second metal plate 82.

The metal plate, the first metal plate and the second metal plate are not particularly limited, but preferably made of copper or stainless steel.

It should be understood that the embodiments and the examples disclosed herein have been presented for the purpose of illustration and description but not limited in all aspects. It is intended that the scope of the present invention is not limited to the description above but defined by the scope of the claims and encompasses all modifications equivalent in meaning and scope to the claims.

INDUSTRIAL APPLICABILITY

The present disclosure is advantageously applicable to a contact separating type thermal fuse which is provided with a movable contact and configured to separate the contacts when an abnormal temperature is sensed.

REFERENCE SIGNS LIST

10, 20, 30, 40, 50: temperature sensitive pellet type thermal fuse; 11, 21, 31, 41, 51: first lead; 12, 22, 32, 42, 52: insulating tube; 13, 23, 33, 43, 53: weak compression spring; 14, 24, 34, 44, 54: strong compression spring; 15, 25, 35, 45, 55: temperature sensitive pellet; 16, 26, 36, 46, 56: peripheral wall; 17, 27, 37, 47, 57: movable contact; 17*a*, 27*a*, 37*a*, 47*a*, 57*a*: projecting contact portion; 47*b*, 57*b*: through hole; 47*c*, 57*c*: contact member; 18, 28, 38, 48, 58: cylindrical case; 19, 29, 39, 49, 59: second lead; 70: sealing material; 80: metal plate; 81: first metal plate; 82: second metal plate; 82*b*: through hole; 90: porcelain tube; 100: contact portion of first lead; 101: annular shoulder of first lead; 110: flange; 120: caulking member

The invention claimed is:

1. A temperature sensitive pellet type thermal fuse comprising:

a cylindrical case which is electrically conductive, and has a first end and a second end;

a temperature sensitive pellet which is disposed inside the cylindrical case proximate the second end, and is configured to melt at a specific temperature;

an insulating tube which is disposed inside the cylindrical case proximate the first end;

a first lead which is inserted into the insulating tube, and has a fixed contact portion at an inner end of the first lead;

a movable contact which is movably disposed inside the cylindrical case, and electrically contacts the cylindrical case;

a weak compression spring which is interposed between a portion of the insulating tube and the movable contact;

a strong compression spring which is stronger than the weak compression spring, and is interposed between the temperature sensitive pellet and the movable contact; and a second lead which is connected to the second end of the cylindrical case;

wherein:

the movable contact includes a movable contact main body and a projecting contact portion which projects from the movable contact main body toward the fixed contact portion of the first lead, the projecting contact portion of the movable contact and the fixed contact portion of the first lead are in contact with one another on a contact plane inside an axial bore of the insulating tube, an annular peripheral wall of the insulating tube circumferentially surrounds and bounds the axial bore, the weak compression spring is arranged coaxially around the annular peripheral wall of the insulating tube, and the contact plane on which the fixed contact portion of the first lead and the projecting contact portion of the movable contact are in contact with one another is located within an axial length of the weak compression spring.

2. A temperature sensitive pellet type thermal fuse comprising:

a cylindrical case which is electrically conductive, and has a first end and a second end;

a temperature sensitive pellet which is disposed inside the cylindrical case proximate the second end, and is configured to melt at a specific temperature;

an insulating tube which is disposed inside the cylindrical case proximate the first end;

a first lead which is inserted into the insulating tube, and has a fixed contact portion at an inner end of the first lead;

a movable contact which is movably disposed inside the cylindrical case, and electrically contacts the cylindrical case;

a weak compression spring which is interposed between a portion of the insulating tube and the movable contact;

a strong compression spring which is stronger than the weak compression spring, and is interposed between the temperature sensitive pellet and the movable contact; and a second lead which is connected to the second end of the cylindrical case;

wherein:

the movable contact includes a movable contact main body and a projecting contact portion which projects from the movable contact main body toward the fixed contact portion of the first lead, the projecting contact portion of the movable contact and the fixed contact portion of the first lead are in contact with one another on a contact plane inside an axial bore of the insulating tube, and the projecting contact portion of the movable contact is formed by embossing.

3. The temperature sensitive pellet type thermal fuse according to claim 1, wherein the projecting contact portion of the movable contact has a thickness greater than the movable contact main body.

4. The temperature sensitive pellet type thermal fuse according to claim 1, wherein the projecting contact portion of the movable contact comprises a contact member which is fixed to the movable contact main body.

5. The temperature sensitive pellet type thermal fuse according to claim 4, wherein the contact member is inserted through the movable contact main body.

6. A temperature sensitive pellet type thermal fuse comprising:

a cylindrical case which is electrically conductive, and has a first end and a second end;

a temperature sensitive pellet which is disposed inside the cylindrical case proximate the second end, and is configured to melt at a specific temperature;

an insulating tube which is disposed inside the cylindrical case proximate the first end;

a first lead which is inserted into the insulating tube, and has a fixed contact portion at an inner end of the first lead;

a movable contact which is movably disposed inside the cylindrical case, and electrically contacts the cylindrical case:

a weak compression spring which is interposed between a portion of the insulating tube and the movable contact;

a strong compression spring which is stronger than the weak compression spring, and is interposed between the temperature sensitive pellet and the movable contact; and a second lead which is connected to the second end of the cylindrical case;

wherein:

the movable contact includes a movable contact main body and a projecting contact portion which projects from the movable contact main body toward the fixed contact portion of the first lead, the projecting contact portion of the movable contact and the fixed contact portion of the first lead are in contact with one another on a contact plane inside an axial bore of the insulating tube, the temperature sensitive pellet type thermal fuse further comprises a metal plate arranged in contact with the movable contact main body, and the projecting contact portion comprises a projecting contact member which is inserted through the movable contact main body and the metal plate, and is fixed to the movable contact main body.

7. The temperature sensitive pellet type thermal fuse according to claim 1, wherein a part of the projecting contact portion in contact with the fixed contact portion of the first lead consists of a contact material.

8. The temperature sensitive pellet type thermal fuse according to claim 4, wherein a part of the contact member in contact with the fixed contact portion of the first lead consists of a contact material, and a part of the contact member in contact with the movable contact main body consists of a material different from the contact material.

9. The temperature sensitive pellet type thermal fuse according to claim 7, wherein the contact material is silver or silver alloy containing at least one element selected from the group consisting of nickel, copper, tin and indium.

10. The temperature sensitive pellet type thermal fuse according to claim 7, wherein the contact material is an oxide alloy containing an oxide of at least one element selected from the group consisting of silver, nickel, copper, tin and indium.

11. The temperature sensitive pellet type thermal fuse according to claim 7, wherein the contact material is copper or copper alloy.

12. The temperature sensitive pellet type thermal fuse according to claim 1, n further comprising a silver layer coated onto a surface of the projecting contact portion.

13. The temperature sensitive pellet type thermal fuse according to claim 4, wherein the contact member consists of AgNi, and the movable contact main body consists of AgCuO or Ag-plated copper alloy.

* * * * *